United States Patent [19]

DePlazes

[11] Patent Number: 4,815,542

[45] Date of Patent: Mar. 28, 1989

[54] GROUND LEVELING ATTACHMENT FOR BOX-SCRAPER

[76] Inventor: Ronald J. DePlazes, 129 W. Elwood, Phoenix, Ariz. 85041

[21] Appl. No.: 118,851

[22] Filed: Nov. 6, 1987

Related U.S. Application Data

[63] Continuation-in-part of Ser. No. 892,118, Aug. 4, 1986, abandoned.

[51] Int. Cl.[4] ..... A01B 27/00; E02F 3/815

[52] U.S. Cl. ..... 172/253; 172/243; 172/445.1; 172/684.5

[58] Field of Search ..... 172/445.1, 778, 832, 172/684.5, 387, 393, 738, 240, 241, 665, 764, 253, 197, 243, 252, 784, 200, 199

[56] References Cited

U.S. PATENT DOCUMENTS

| | | | |
|---|---|---|---|
| 1,126,805 | 2/1915 | McCaulou | 172/684.5 |
| 2,067,374 | 1/1937 | Beach . | |
| 2,285,706 | 6/1942 | Gaddis . | |
| 2,433,019 | 12/1947 | Arps | 172/445.1 |
| 2,536,308 | 1/1951 | Pierce | 172/777 |
| 2,624,133 | 1/1953 | Smeed | 172/780 |
| 2,795,060 | 6/1956 | Geizler | 172/199 |
| 2,868,306 | 1/1959 | Key | 172/200 |
| 2,896,343 | 7/1959 | Raby . | |
| 2,897,615 | 8/1959 | Hills et al. . | |
| 3,136,078 | 6/1964 | Renault | 172/778 X |
| 3,145,489 | 8/1964 | Smith | 172/200 X |
| 3,336,685 | 8/1967 | Keller | 172/445.1 |
| 3,556,228 | 1/1971 | Mork | 172/445.1 |

OTHER PUBLICATIONS

Gannon Advertizing Brochures 3G-102 and 3G-112.

*Primary Examiner*—Richard J. Johnson
*Attorney, Agent, or Firm*—Tod R. Nissle

[57] ABSTRACT

An attachment for a box-scraper. The box-scraper includes a pair of spaced apart walls each having a lower edge; a horizontally oriented frame member mounted intermediate the side walls; and, an elongate blade mounted intermediate the walls and having a leading edge. The attachment facilitates leveling of the ground and includes a first horizontally oriented member having a lower ground engaging surface; a pair of flange portions upwardly depending from the first elongate member and each having an upper surface normally bearing against the lower edge of one of the side walls, at least one of the flange portions having an inner wall normally bearing against the leading edge of the blade; and, apparatus connected to the attachment and the frame to maintain the attachment in position on the box-scraper.

2 Claims, 2 Drawing Sheets

FIG. 6
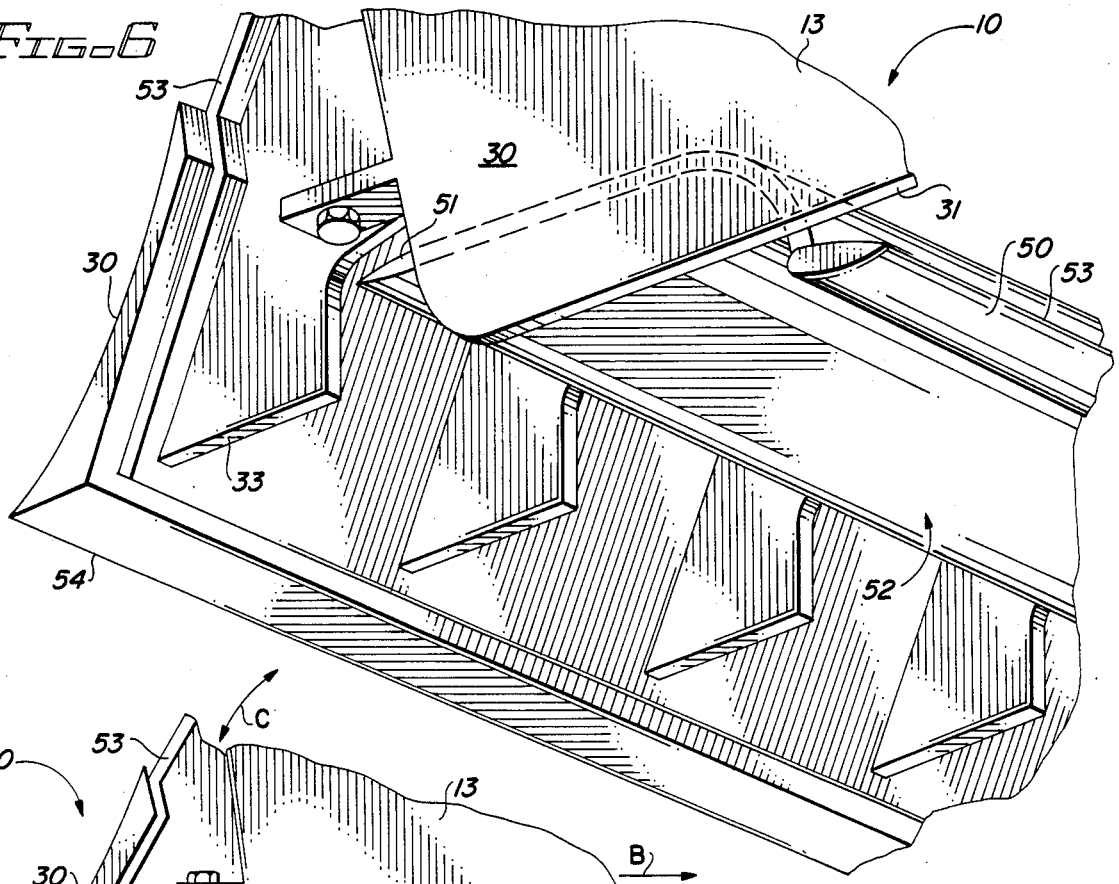
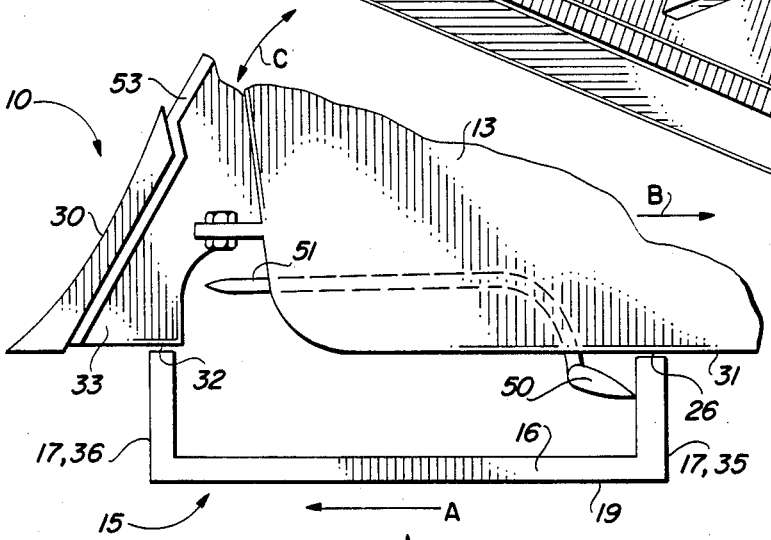
FIG. 7
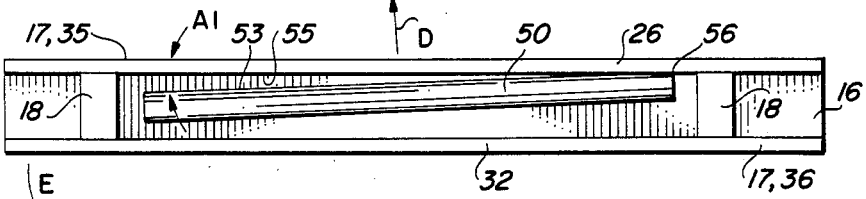
FIG. 8
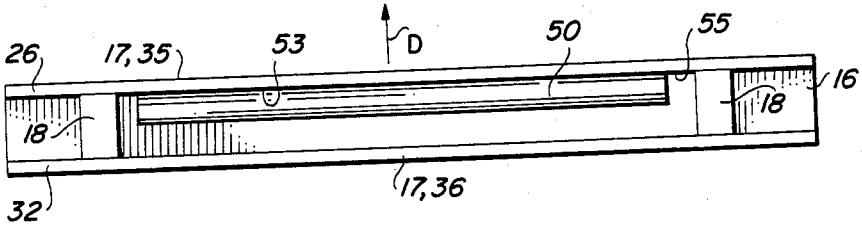
FIG. 9

GROUND LEVELING ATTACHMENT FOR BOX-SCRAPER

This is a continuation-in-part of application Ser. No. 892,118 filed Aug. 4, 1986, now abandoned.

This invention relates in general to earth moving equipment and more particularly to a fine leveling device for attachment to a box-scraper which is a known mechanism for achieving coarse leveling and is moved along by a bulldozer or other tractor like vehicle of the types used in earth moving operations.

A bulldozer and similar earth moving equipment, is basically a tractor which is equipped with large drive wheels or tracks to enable passage over unfinished ground surfaces. The bulldozer can be used to drag, push or otherwise move a heavy tool called a box-scraper. This tool is intended to encounter material such as earth or stone, in small hills or heaps, and to distribute the material along the path followed by the bulldozer to achieve an approximately level topography. A box-scraper can also be used to flatten or alter an undesirable slope.

A box-scraper is a heavy and durable steel tool, and is usually of the form of a rectangular box which is open at the top and bottom. The relatively short ends of the box are intended to prevent escape of material sideways to void the scraper blade which forms one of the longitudinal sides of the "box". The scraper blade meets the ground at an angle which can be altered by a hydraulic control system or which can be set and fixed by locking pins. Contact with the ground is of approximately a line-to-plane geometry.

Box-scrapers are conventional and are commercially available. U.S. Pat. Nos. 2,897,615 to Hills et al; 2,433,019 to ARPS; and 2,624,133 to Smeed disclose tools which are similar to the tool described herein as box-scraper, and the exact tool which is used extensively in the art, is presently marketed by the Gannon Manufacturing Co. Inc. of 14882 East Firestone Boulevard, La Mirado, Calif. 90638 and 1001 Schriever Street, Sequin, Tex. 89155.

The Gannon box-scraper is equipped with a plurality of plow-like extensions called scarifiers. These are used for scarifying a surface with furrows. A description of box-scraper from the Gannon Co. is entitled "Gannon Landscaper" and bears the designation 3G-102. Another such publication is entitled "Hydraulic Landscaper" and bears the designation 3G-112 Copies of these publications have been made a part of the public record of this patent application in the United States Patent Office. Similar advertising copy is available from other manufacturers of farm and highway machinery.

The term "box-scraper" as employed by this patent is defined as the tool described by the Gannon publications, incorporated herein by reference, and is additionally intended to encompass tools, manufactured by others, which are substantially similar mechanically and which are also intended for surface leveling, restricted however to such tools as are pushed or pulled by a earth moving machine.

A bulldozer and other earth moving machines are engine driven vehicles, the designs of which are well known and which form no part of this invention.

For many applications, the result of a single pass of a box-scraper over a surface is not satisfyingly level or "fine". After additional passes, the surface may be sufficiently smooth, or the application of hand labor may be required.

A "fine level surface" is defined herein as a surface of loose material which is flat and smooth; to an extent not normally achieved by a box-scraper. To some extent the definition encompasses a subjective judgment as to what constitutes a "fine" surface. If the material is earth, certainly large clods must have been crushed or submerged to render the surface fine. If the material is sand or gravel, ripples and ridges, valleys, and mounds should not be apparent.

It is an object of this invention to provide a tool which attaches to a box-scraper and which enables a single passage of the combined tool and box-scraper over a coarse surface to create in its wake a surface which is described as fine level.

It is a further object of this invention to provide such a tool which is easily removable and installable on a box-scraper so that the box-scraper can continue to be usable for coarse leveling.

An attachment for a box-scraper is described which consists of a flat surface channel, or beam, extending approximately the length of the box-scraper, having means of attachment to the box-scraper. The channel may have two vertical supports which have lugs to hook over a top edge of the box-scraper. The supports adjust in length. Reduction of the length, as by turning two bolts, causes an upper surface of the channel to abut with a lower surface of the box-scraper, thereby in conjunction with the lugs, rigidly securing the attachment to the box-scraper.

The contact surface of the attachment to the ground is normally a rectangular surface of relatively broad area. This area sweeps over the ground in the wake of the earth moving tractor. The result is a fine level ground surface.

FIG. 6 is a bottom perspective view of a portion of the box-scraper of FIGS. 1 to 3;

FIG. 7 is a side elevation view of the box-scraper of FIG. 6 illustrating the normal operative position of the attachment of the invention;

FIG. 8 is a top view illustrating the mode of operation of the invention; and, FIG. 9 is a top view further illustrating the mode of operation of the invention.

The invention is the basic form of an elongated flat rectangular plate which is arranged for demountable attachment to a box-scraper to bear against and ride over the ground surface to be leveled. The plate has a flange at each longitudinal edge of the plate which are disposed at a right angle to the plate, and are for mounting purposes and serve to prevent the material being leveled from riding over the plate when moved in either a forward or backward direction. The plate and two flanges form a rectangular channel shaped beam, which is demountable and rigidly attached to the box-scraper.

Passage of the beam means over the ground has a crushing, grinding, smoothing distributing effect on material particles such that the surface left in the wake of passage of the tool is a fine level surface, smooth, level, and flat.

In a preferred mode for attachment to the box-scraper, two lugs are welded or otherwise provided each on a hollow cylinder or sleeve, which fits over a threaded rod. A nut on each rod adjustably secures the cylinder on one end of the rod. The rod is bolted at the other end to a rectangular member which is welded to the channel shaped beam formed by the plate and its flanges.

Figure 1:
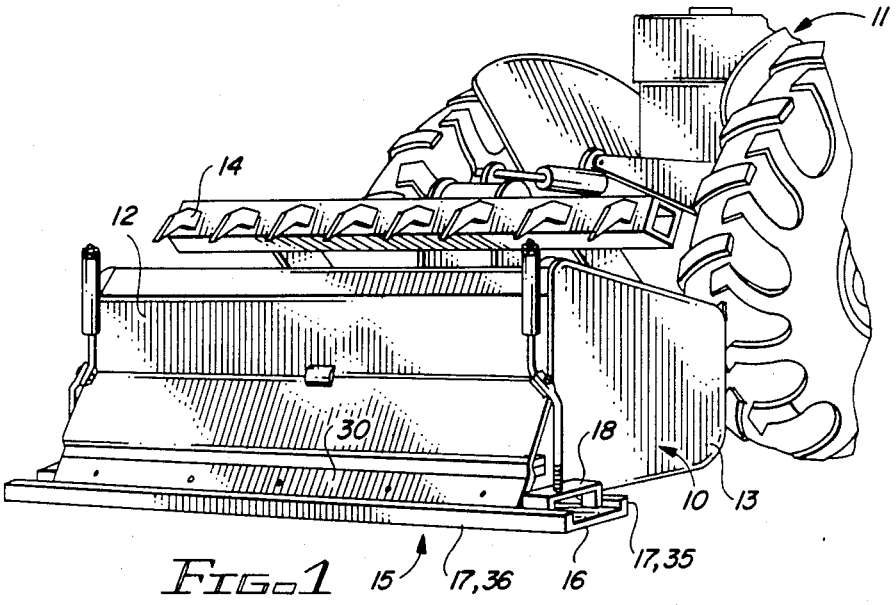
FIG. 1 is a perspective view of a typical box-scraper which is shown as being attached and towed behind a bulldozer or other similar vehicle the details of which are omitted for clarity, with the fine level attachment of the present invention being shown in one installed position on the box-scraper.
Figure 2:
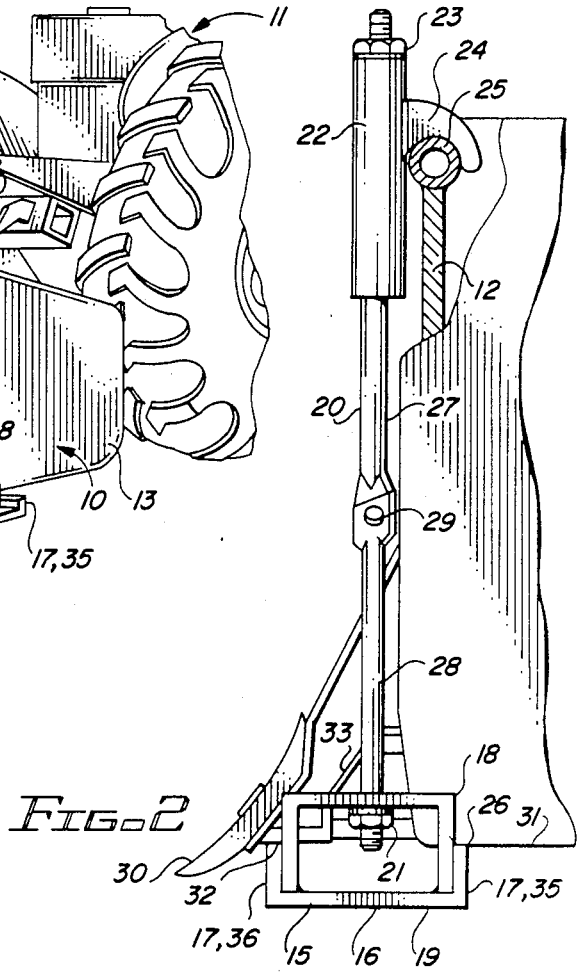
FIG. 2 is an enlarged fragmentary end view of the box-scraper which is partially broken away to show the details of the fine level attachment of the present invention.

The above description will be more clearly understood when taken with reference to the drawings. Refer to FIG. 1. A box-scraper 10 is mounted for towing behind a tractor 11. Box-scraper 10 is roughly a box, having opposed end sides 13 (one shown), and a front side 12. This box-scraper is shown as having hydraulically operated scarifiers 14, now retracted upward out of use. The box-scraper, as is well known in the art, is also provided with suitable hydraulic mechanisms for raising, lowering and tilting the box-scraper. The invented fine level attachment, which is indicated generally by the reference numeral 15, is demountably attached to the box-scraper 10 and is therefore moveable therewith. Refer to FIG. 2. Fine level attachment 15 has a flat plate 16 disposed to bear on the ground. The flat plate 16 has two upstanding flanges 17 which may be formed integrally, welded, or otherwise provided on the flat plate 16. The flat plate 16 and its flanges 17 form a channel, or beam means 19 which is U-shaped in cross section, as especially seen in FIG. 2. Two inverted U-shaped braces 18 are disposed at two spaced locations along channel 19 and are attached thereto such as by welding. These braces 18 fit inside channel 19, as shown in FIG. 2, or may extend over the outside of flanges 17. Two threaded rods 20 extend through braces 18 and are bolted thereto such as by means of the lower nuts 21. At an upper end of each rod 20, a cylinder or sleeve 22 fits over each rod 20 for axial movement therealong and is adjustably bolted to the rods 20 by the upper nuts 23. A lug 24 is provided on each cylinder 22 for hooked over engagement with a top edge 25 on the front side 12 of the box-scraper 10. When the upper nut 23 is tightened, the channel 19 is drawn upward until the top edge 26 of one of one of the flanges 17 abuts with a bottom edge 31 of the end sides 13 of the box-scraper. When the upper nuts 23 are further tightened, the fine level attachment 15 as a whole becomes rigidly secured to box-scraper 10.

There may be two, three, or more combinations or rods 20, nuts 21, cylinders 22, and lugs 24 to provide support at two, three, or more locations.

Figure 3:
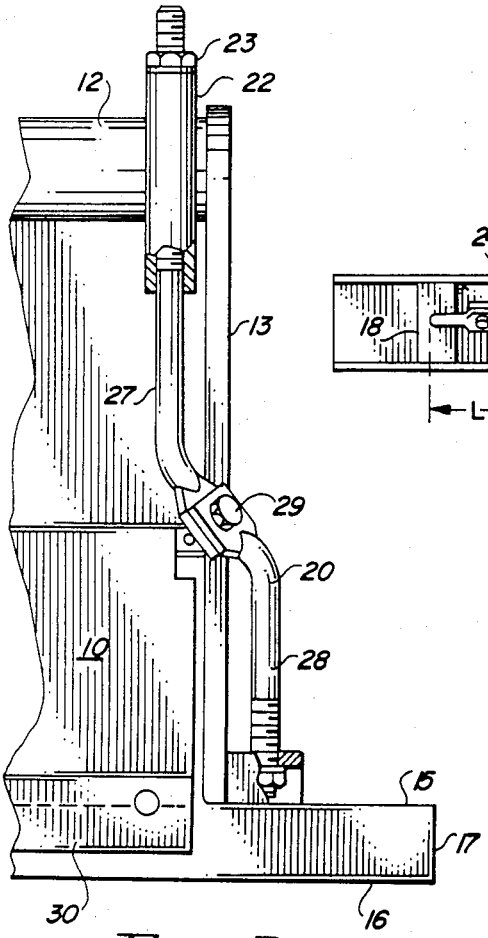
FIG. 3 is a fragmentary front elevation view showing the mounting details of the fine level attachment to the box-scraper.
Figure 4:
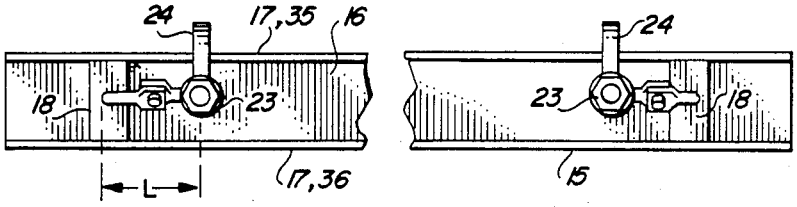
FIG. 4 is a top plan view of the fine level attachment.

The rods 20 need not be straight and may be broken into joinable sections. In FIGS. 2 and 3 an upper rod section 27 is shown as being attached by a suitable bolt 29 to a lower rod section 28 to form a whole rod 20. FIG. 4 defines an offset "L" between the vertical position of the bolt 23 (and the upper rod 27) and the lower rod 28. This offset is included to enable the lug 24 to engage the front top edge 25 of the box-scraper 10 while the braces 18 are separated a distance greater than the total width of the box-scraper 10. That is, the braces 18 are each located proximate different ones of the sides 13 of box-scraper 10. To accomplish this, the total rod assembly 20 must be bent first in a plane parallel to front side 12 of box-scraper 10 and also bent in a plane parallel to side 13 of box-scraper 10. The first bend is in upper rod 27, the second bend is in lower rod 28.

Refer again to FIG. 1. This figure shows a scraper blade 30 of the box-scraper 10 as being disposed to bear against the upper surface of the plate 15 along the entire length of the scraper blade 30, between the flanges 17. In this mode of operation, the tightening of nuts 23 causes fine level attachment 15 to butt against scraper blade 30 in addition to the lower edges 31 of sides 13.

Refer to FIG. 2. The forward flange 17, 36 of channel 19 bears against an auxiliary bracket 33 which is an integral part of the box-scraper 10 for supporting the scraper blade 30 and provides an abutment with the upper edge 32 of the forward flange 17, 36.

Figure 5:
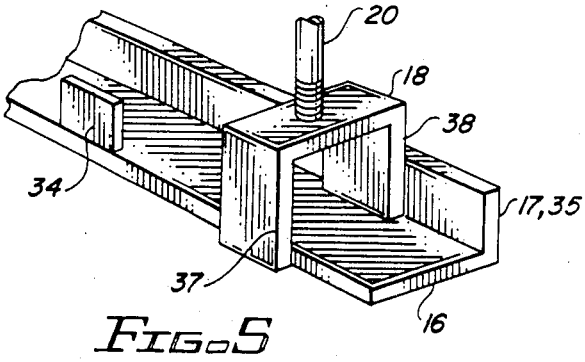
FIG. 5 is a fragmentary perspective view of a modification of the level attachment of the present invention.

An alternative design for channel shaped beam means 19 is shown by FIG. 5. In this concept, the beam means 19 has only one flange 17, which is the rearwardly disposed flange 35. The forward flange 17, 36 has been eliminated. The braces 18 now have a long leg 37 and a short leg 38. The long leg 37 exceeds the length of the short leg 38 by the thickness of the plate 16. This arrangement provides for greater strength because the long leg 37 positively resists pressure on the flange 37, 35 due to impact wit earth material. However, the elimination of the flange 17, 36 would appear to leave no top edge 32 for support. Consequently, as shown in FIG. 5 the flange pieces 34 may be welded to plate 16 at intervals along its length to replace the flange 17, 36 and to butt against the auxiliary bracket 33.

FIGS. 6 and 7 further illustrate the mounting of the ground leveling attachment of the invention on a box-scraper. As shown in FIG. 6, the box-scraper, specifically the Gannon Hydraulic Landscaper produced by Gannon Manufacturing Co. Inc. of 14882 East Firestone Blvd., La Mirado, Calif. 90638, as described in Gannon Publication 3G-112, includes rear scraper blade 30 and forward inner scraper blade 50. Blade 50 is removably attached to elongate frame member 52. Member 52 is fixedly attached at either end to one of the parallel sides 13 of the box-scraper 10. The leading edge 53 of front blade 50 is generally parallel to the elongate linear leading edge 54 of blade 30.

In FIG. 7 only the flanges 17 and plate 16 of the ground leveling attachment of the invention are, for the sake of clarity, shown. Brace 18, rod 28, rod 20, nut 21, cylinder 22, and lug 24 shown in FIG. 2 are omitted in FIG. 7. In FIG. 7 upper edge 32 of flange 17, 36 bears against bracket 33 while the upper edge 26 of flange 17, 35 bears against the lower edge 31 of side 13. If desired, the attachment 15 of the invention can be sized such that edge 32 bears against lower surface 51 of elongate frame member 52 or against edge 31. The inner surface 55 of flange 17, 35 bears against the leading edge 53 of blade 50. This is a crucial feature of the attachment of the invention. When the box-scraper 10 is pulled by a tractor in the direction of arrow B, blade 50 prevents attachment 15 from sliding rearwardly in the direction of arrow A.

The flanges 17 need not span the entire length of plate 16, but can instead only consist of the portions of said flanges necessary to support the portions of upper edges 32 and 26 bearing against lower edges 31 of walls 13.

FIGS. 8 and 9 illustrate the procedure for mounting the attachment 15 of the invention on a box-scraper. In FIGS. 8 and 9, rod 28, rod 20, nut 21, cylinder 22, and lug 24 have, for the sake of clarity, been omitted from the drawing of attachment 15. Similarly, the only structural component of the box-scraper of FIGS. 1-3, 6 and 7 shown in FIGS. 8 and 9 is blade 50. however it is understood that movement of blade 50 in FIGS. 8 and 9 as described herein is accomplished in conjunction with movement of the entire box-scraper, where the box-scraper is attached to a tractor.

In order to mount the attachment 15 on a box-scraper, attachment 15 is positioned on the ground in the orientation illustrated in FIG. 4. FIG. 4 is a top view of the box-scraper. The box-scraper is then elevated a distance above the ground sufficient to permit the leading edge 53 of blade 50 to be at a height above the ground which is greater than the height above the ground of edge 26. The tractor carrying the box-scraper is then backed up to position blade 60 above plate 16. If desired any motive power means other than a tractor can be utilized to move the box-scraper over the ground. The scraper, and blade 50 in the box-scraper, is then lowered such that leading edge 53 is positioned intermediate flanges 17 at a height above the ground less than the height of edge 26 above the ground. FIG. 8 illustrates the respective positions of attachment 15 and blade 50 when blade 50 has been lowered and edge 53 is intermediate flanges 17. The ability to raise and lower the box-scraper of FIGS. 1-3, 6 and 7 in the manner indicated by arrow C in FIG. 7 is well known to those of ordinary skill in the art, and is accomplished with any of a variety of height control apparatus operatively associated with the box-scraper and/or the tractor carrying the box-scraper.

In FIG. 8 leading edge 53 and edge 26 are both horizontally oriented, but edge 53 is canted, i.e., is at an angle A1 to face 55.

After blade 50 is lowered to the position of FIG. 8, the tractor carrying box-scraper 10 is driven in the direction of arrow D. After blade 50 is lowered to the position of FIG. 8, leading edge 23 ordinarily, as shown in FIG. 8, will not be parallel to the inner face 55 of flange 17, 35. As the tractor moves in the direction of arrow D, end 56 of edge 53 contacts inner face 55, and plate 16 and flanges 17 simultaneously rotate about end 56 in the direction of arrow E until the entire leading edge 53 of blade 50 is contacting inner face 55. In other words, face 55 and attachment 15 self align to leading edge 53. Edge 53 is fixedly mounted on the box-scraper and will not rotate in the direction of arrow E. Once leading edge 53 is parallel to and contacting face 55, the forward movement of the tractor and box-scraper 10 is temporarily stopped so lug 24 can be positioned over edge 25 and so nut 23 can then be used to secure attachment 15 on scraper 10. Once attachment 15 is fixedly secured on scraper 10, movement of the tractor is continued in the direction of arrow D and attachment is used to level the ground. FIG. 9 illustrates the position of edge 53 against face 55 after attachment 15 has aligned itself to leading edge 53 and attachment 15 has been removably secured to scraper 15 with lug 24 and nut 23. When attachment 15 is fixedly secured to the box-scraper, edge 26 bears and is forced against edge 31, edge 32 bears and is forced against bracket 33, and edge 53 is against inner face 55.

It is intended that all members of this tool be fabricated of heavy, substantial steel stock for strength and durability, or be fabricated of any other appropriate material.

While in the specification and in the drawings, a general conception of a fine level attachment for a box-scraper has been described, it should be understood that various modifications can be accomplished using merely routine engineering practices, without rising to the level of invention and without departure from true spirit and scope of this invention. Therefore the specification should not be considered as illustrative and not limiting.

Having described my invention in such terms as to enable those skilled in the art to understand and practice it, and having identified the presently preferred embodiments thereof:

I claim:

1. An attachment for a box-scraper, said box-scraper including a frame including a pair of spaced apart walls each having a lower edge and a horizontally oriented elongate frame member mounted intermediate and spanning the distance between said side walls; and, a horizontally oriented elongate blade mounted intermediate said walls and having a leading edge, said attachment facilitating leveling of the ground and including (a) a first elongate horizontally oriented member having a lower ground engaging surface;

(b) a pair of flange portions upwardly depending from said first elongate member and each having an upper surface normally bearing against said lower edge of one of said walls, at least one of said flange portions having an inner wall normally bearing against said leading edge of said blade;

(c) means connected to said attachment and said frame to maintain said attachment in position on said box-scraper with said upper surfaces of said flange portions each bearing against said lower edge of one of said walls and with said inner wall of said one of said flange portions against said leading edge of said blade.

2. A method for equipping a box-scraper with apparatus for leveling the ground, said box-scraper including a frame having a pair of spaced apart walls each having a lower edge and a horizontally oriented elongate frame member mounted on and spanning the distance between said side walls, a horizontally oriented elongate blade mounted intermediate said walls and having a leading edge, height control means operatively associated with said frame for upwardly and downwardly displacing said frame and blade, and, motive power means for moving said box-scraper over the ground, said method comprising the steps of (a) setting leveling apparatus on the ground, said apparatus including (i) a first elongate horizontally oriented member having a lower ground engaging surface, (ii) a pair of flange portions upwardly depending from said first elongate member and each having an upper surface normally bearing against said lower edge of one of said walls when said apparatus is mounted on said box-scraper, said flange portions each having an inner wall normally bearing against said leading edge of said blade when said apparatus is mounted on said box-scraper, and (iii) connection means for removably securing said apparatus to said frame to maintain said apparatus in position on said box-scraper with said upper surfaces of said flange portions each bearing against said lower edge of one of said walls and with said inner walls of said flange portions against said leading edge of said blade;

(b) adjusting said box-scraper with said height control means to position said leading edge at a height above the ground greater than the height above the ground of said upper surfaces of said flange portions;

(c) moving said box-scraper with said motive power means to position said leading edge over said first member;

(d) lowering said box-scraper with said height control means until said leading edge is over said first member at a height above the ground less than the height above the ground of said upper surfaces of said flange portions and said leading edge is canted in a horizontally oriented plane with respect to said flanges;

(e) moving said box-scraper forwardly over the ground with said motive power means such that said leading edge contacts said one of said inner walls and said one of said inner walls pivots about a point on said leading edge until said inner walls self align with said leading edge and said leading edge contacts said inner walls;

(f) securing said apparatus to said box-scraper with said connection means.

* * * * *